United States Patent [19]

Hitzeroth et al.

[11] Patent Number: 4,580,853

[45] Date of Patent: Apr. 8, 1986

[54] UNDERCABINET MOUNTING ARRANGEMENT FOR COOKING APPLIANCES

[75] Inventors: Franklin C. Hitzeroth, Columbia; Gilbert S. Aderton, Bucklin, both of Mo.

[73] Assignee: Toastmaster Inc., Columbia, Mo.

[21] Appl. No.: 649,695

[22] Filed: Sep. 12, 1984

[51] Int. Cl.[4] ..... A47F 5/08; A47H 1/10

[52] U.S. Cl. ..... 312/245; 248/327; 248/317

[58] Field of Search ..... 312/257 A, 263, 243, 312/245, 247; 126/1 E, 18, 19 M, 21 R, 80, 83; 244/158 R; 248/59, 201, 317, 327, 58; 108/149

[56] References Cited

U.S. PATENT DOCUMENTS

| | | | |
|---|---|---|---|
| 1,260,123 | 3/1918 | Areson | 248/327 |
| 2,729,411 | 1/1956 | Cahill | 248/327 |
| 3,698,780 | 10/1972 | Collins | 312/245 |
| 4,313,043 | 1/1982 | White | 312/245 |
| 4,327,274 | 4/1982 | White | 312/236 |

*Primary Examiner*—William E. Lyddane
*Assistant Examiner*—Gerald A. Anderson
*Attorney, Agent, or Firm*—Kokjer, Kircher, Bradley, Wharton, Bowman & Johnson

[57] ABSTRACT

A mounting assembly for mounting a cooking appliance such as a toaster oven broiler to the bottom of a kitchen cabinet. A bracket plate is adjustably secured to a pair of hanger brackets which are bolted to the bottom of the cabinet. The bracket plate includes downwardly projecting hooks on which the appliance can be suspended. The bracket plate acts as a heat shield to prevent excessive heating of the cabinet and has a deflector panel which deflects heat, grease vapor and moisture away from the front of the cabinet.

11 Claims, 8 Drawing Figures

UNDERCABINET MOUNTING ARRANGEMENT FOR COOKING APPLIANCES

BACKGROUND AND SUMMARY OF THE INVENTION

This invention relates generally to the mounting of kitchen appliances and deals more particularly with an undercabinet mounting assembly for toaster oven broilers and other cooking appliances which generate significant amounts of heat.

In order to conserve valuable counter space in the kitchen, various appliances and accessories have in recent years been mounted beneath kitchen cabinets. When cooking appliances such as toaster oven broilers are involved, difficult problems are encountered in mounting them to cabinets. Because of the heat created when appliances of this type are in operation, the cabinet can be heated to an excessive and sometimes dangerously high temperature when the appliance is located immediately beneath it. In addition, the cooking operation generates moisture and grease vapors which, when released from the oven cavity of the toaster oven broiler, can condense on the doors and front portions of the kitchen cabinet to cause discoloration and other damage to the cabinet finish. The heat which is released when the door of the toaster oven broiler is opened can also damage the cabinet and its finish.

Some of the mounting arrangements that have been used to mount appliances beneath kitchen cabinets are suitable only for new cabinet construction and cannot be readily applied to existing cabinets. Those that are suitable for application to cabinets that have already been installed are difficult for even skilled homeowners to properly attach to the cabinet. Another drawback is that each mounting assembly is suitable for only one cabinet size and style.

The present invention is directed to an improved undercabinet mounting arrangement which serves to mount a cooking appliance such as a toaster oven broiler to the bottom of a kitchen cabinet. It is the principal goal of the invention to provide an undercabinet mounting assembly which securely mounts a toaster oven broiler to a cabinet and at the same time protects the cabinet from the heat and vapors generated by the appliance.

More specifically, it is an object of the invention to provide an undercabinet mounting assembly which includes a heat shield between the appliance and the bottom of the cabinet to prevent the cabinet from being subjected to excessive heat.

Another object of the invention is to provide an undercabinet mounting assembly which includes a deflector for deflecting heat and vapors away from the front of the cabinet when the appliance door is opened.

Yet another object of the invention is to provide an undercabinet mounting assembly having parts which are adjustable to accommodate cabinets having different sizes and styles. The hanger brackets and bracket plate are adjustable relative to one another to compensate for cabinet rails having different heights. The deflector is also adjustable to accommodate cabinet doors which differ in thickness and location on the cabinet.

A further object of the invention is to provide an undercabinet mounting assembly which securely mounts the toaster oven broiler to the bottom of a cabinet and yet permits the appliance to be quickly and easily removed.

An additional object of the invention is to provide an undercabinet mounting assembly which can be quickly and easily applied both to new cabinets and to cabinets that are already installed.

A still further object of the invention is to provide an undercabinet mounting assembly which is constructed in a simple and economical manner and which has an attractive appearance.

Other and further objects of the invention, together with the features of novelty appurtenant thereto, will appear in the course of the following description.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
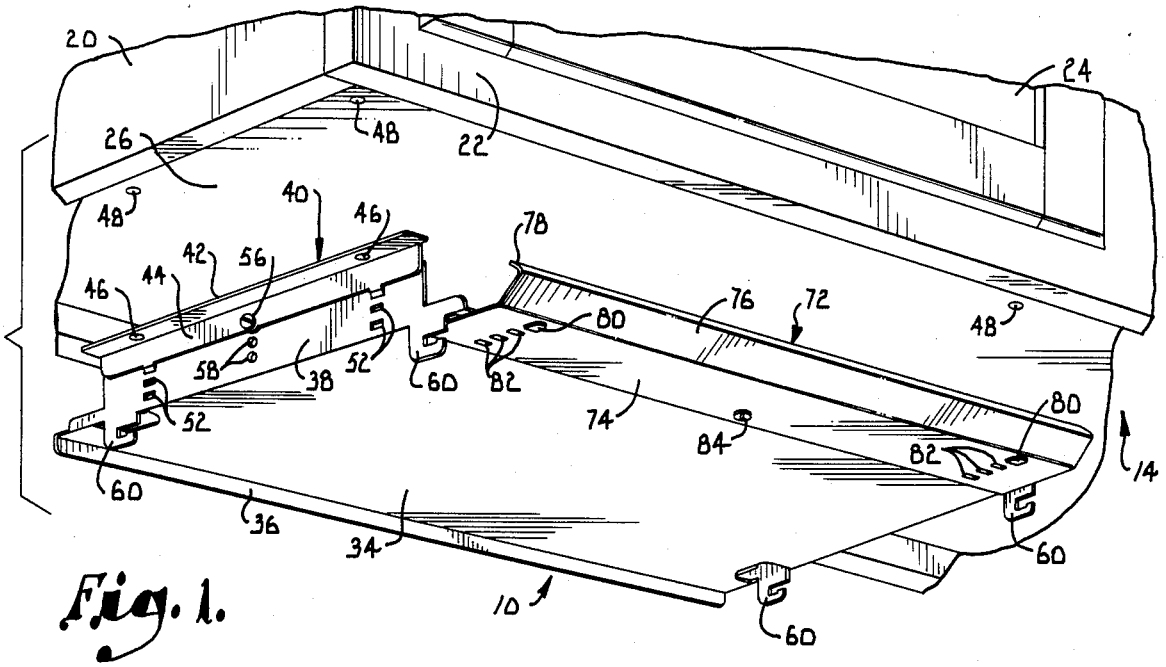
FIG. 1 is a perspective view of an undercabinet mounting assembly constructed according to a preferred embodiment of the present invention and showing its manner of application to a cabinet.

Referring now to the drawings in more detail, numeral 10 generally designates an undercabinet mounting assembly which serves to mount a kitchen cooking appliance such as a toaster oven broiler 12 to the underside of a kitchen cabinet 14. The toaster oven broiler is a conventional appliance which operates electrically to toast, bake, broil, brown and warm various types of foods. The toaster oven broiler is a box like structure having an enclosed oven cavity for receiving foods. A hinged access door 16 on the front of the toaster oven broiler 12 can be opened to provide access to the oven cavity. The door 16 opens about a hinge extending along its lower edge and is equipped with a handle **16*a* to facilitate its opening and closing. The top of the toaster oven broiler is formed by a top panel 18. A control panel 19 is mounted to one side of door 16** and includes suitable controls for operating the appliance. The exact details of the toaster oven broiler are not important to the present invention and will not be further described.

Figure 6:
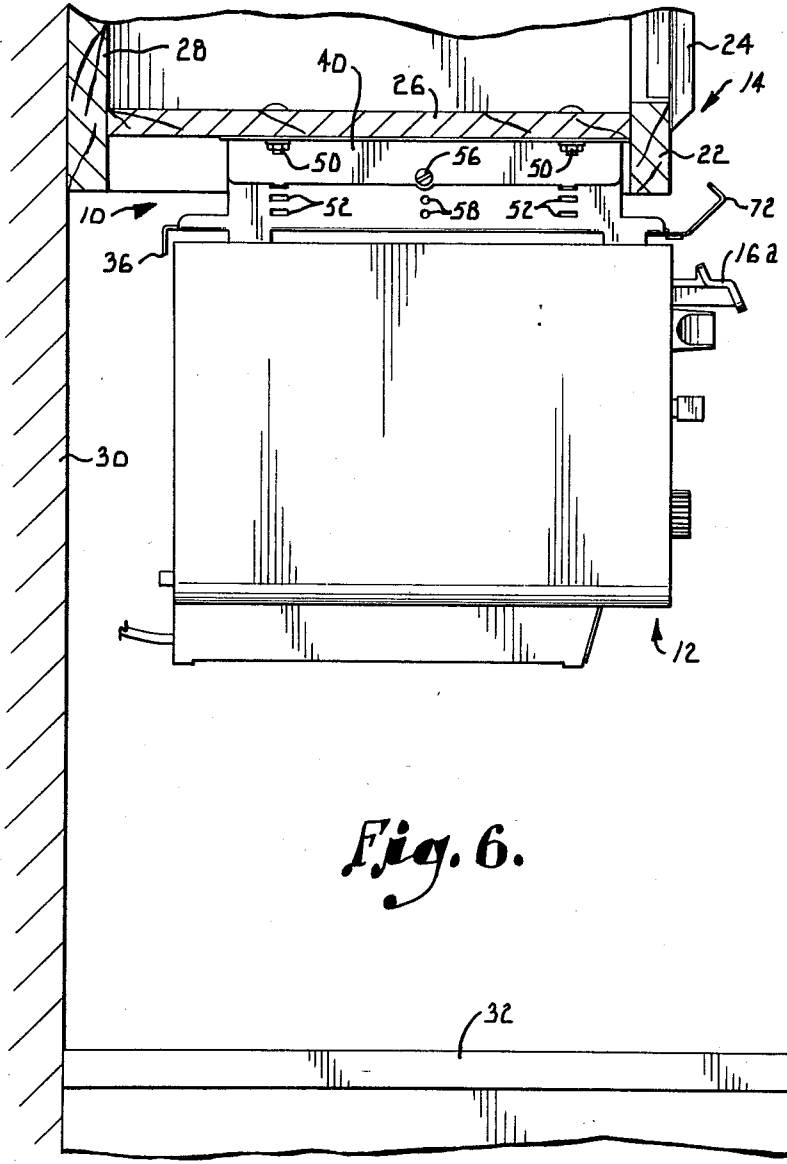
FIG. 6 is a side elevational view showing the mounting assembly installed to mount the toaster oven broiler to the bottom of a kitchen cabinet.

The kitchen cabinet 14 can likewise have various sizes and styles. As shown in the drawings, the cabinet 14 includes opposite side panels 20 and a front panel 22 provided with a hinged door 24 which can be opened and closed to provide access to the interior of the cabinet. The cabinet also has a horizontal bottom panel 26 which normally forms the lower shelf of the cabinet. As shown in FIG. 6, the cabinet has a back panel 28 which is secured against a wall 30 with the cabinet located well above a counter 32. It is to be noted that the mounting assembly of the present invention can be used with virtually any known type of kitchen cabinet whether constructed of wood or metal.

The undercabinet mounting assembly 10 includes a generally flat bracket plate 34 which may be formed from metal or any other suitable material. A down turned flange 36 is formed along the back edge of the bracket plate 34. A pair of upturned sides 38 extend upwardly from plate 34 along its opposite sides.

A pair of hanger brackets 40 serve to mount the bracket plate 34 to the cabinet 14. Each hanger bracket 40 is formed by an angle having a horizontal flange 42 and a vertical flange 44. The horizontal flange 42 of each hanger bracket is provided with a pair of openings 46. As shown in FIG. 1, the bottom panel 26 of the cabinet can be provided with holes 48 at locations to align with the hanger bracket openings 46. Then, as shown in FIG. 6, nut and bolt assemblies 50 can be inserted through the aligned holes and tightened to thereby secure the hanger brackets 40 to the underside of the cabinet bottom panel 26.

Figure 5:
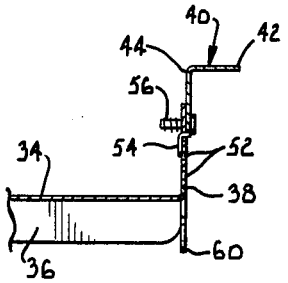
FIG. 5 is a fragmentary sectional view taken generally along line 5—5 of FIG. 4 in the direction of the arrows.
Figure 7:
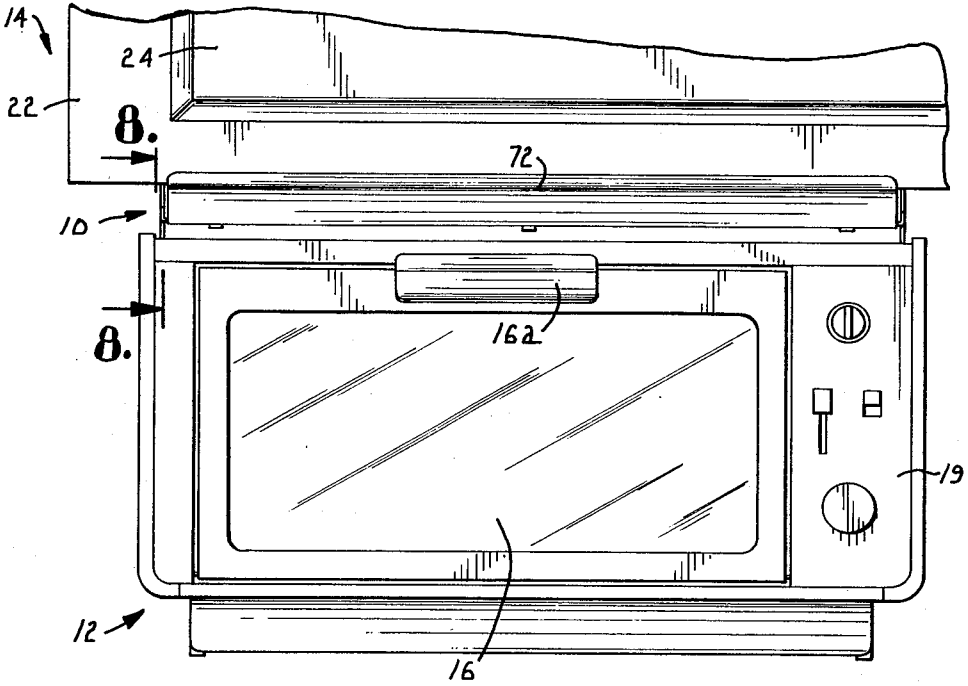
FIG. 7 is a front elevational view showing the toaster oven broiler mounted to the cabinet.

The bracket plate 34 is secured to the hanger brackets 40 and may be adjusted thereon. Each of the sides 38 of the bracket plate is provided with two sets of slots 52. Each set of slots includes three slots which are spaced vertically from one another in a uniform manner. The bottom edge of the vertical flange 44 of each hanger bracket 40 is provided with a pair of projecting tabs 54 which fit through the slots 52. As best shown in FIG. 5, each tab 54 is bent away from flange 44 and is then turned downwardly to occupy a plane parallel to the plane occupied by flange 44.

Figure 2:
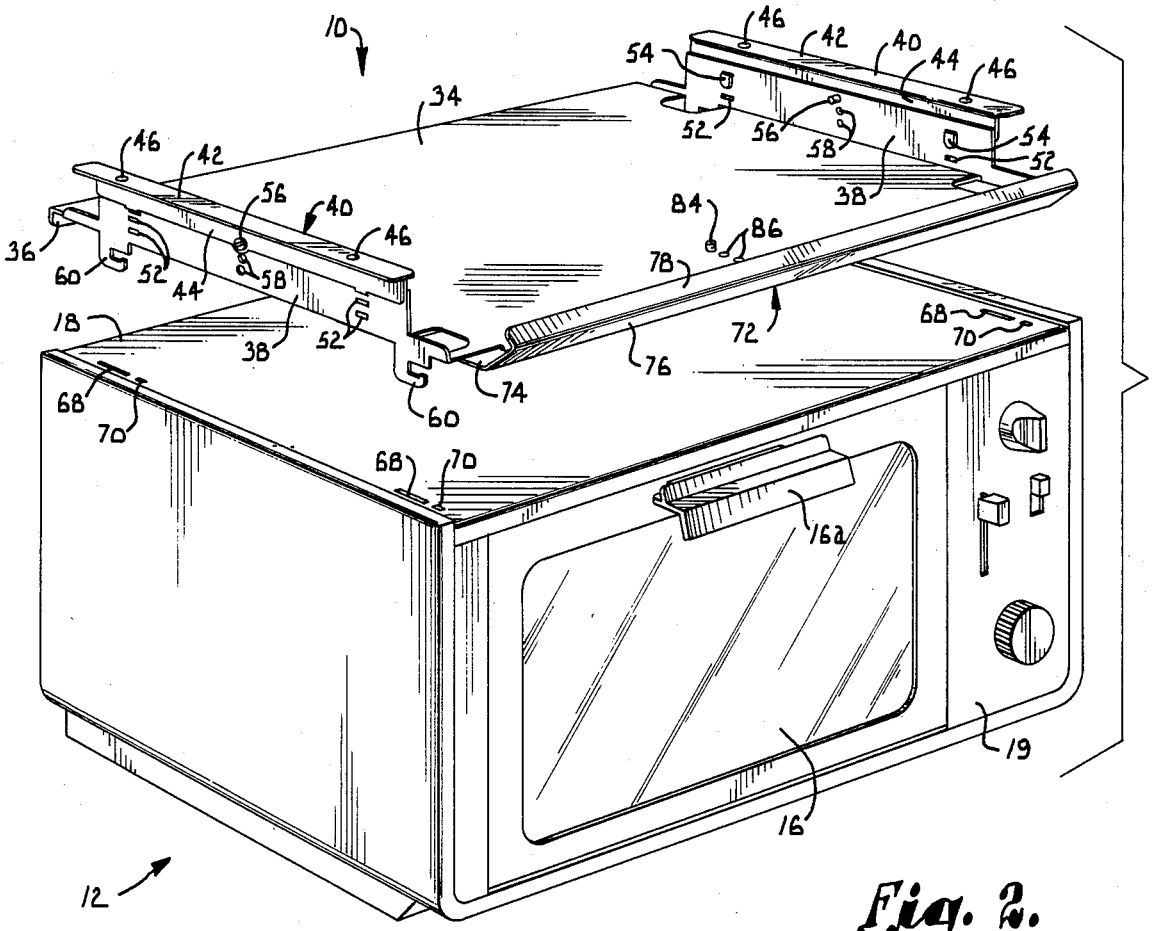
FIG. 2 is a perspective view showing the manner in which a toaster oven broiler appliance is applied to the mounting assembly of the present invention.
Figure 3:
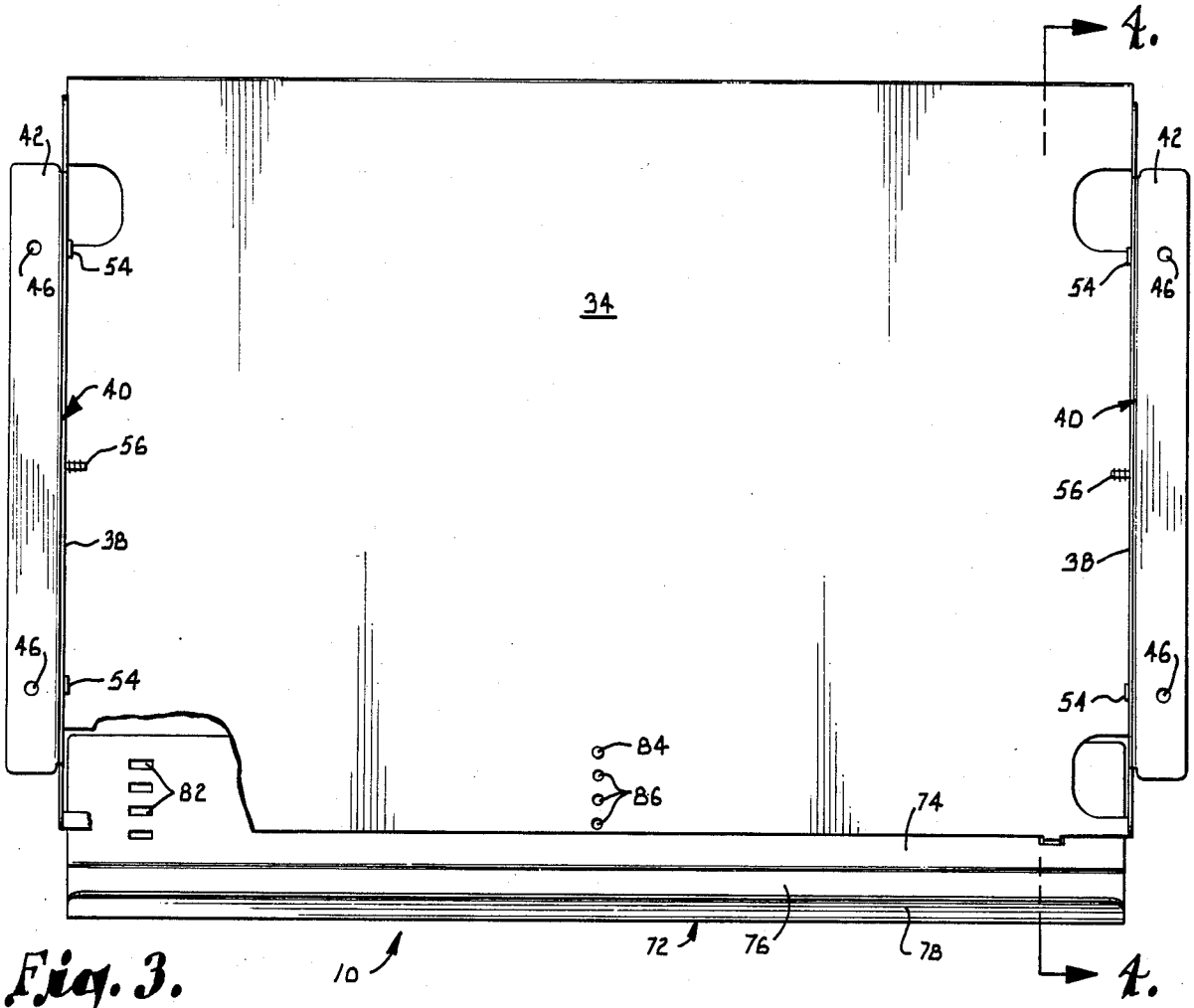
FIG. 3 is a top plan view of the mounting assembly on an enlarged scale, with a portion broken away for purposes of illustration.
Figure 4:
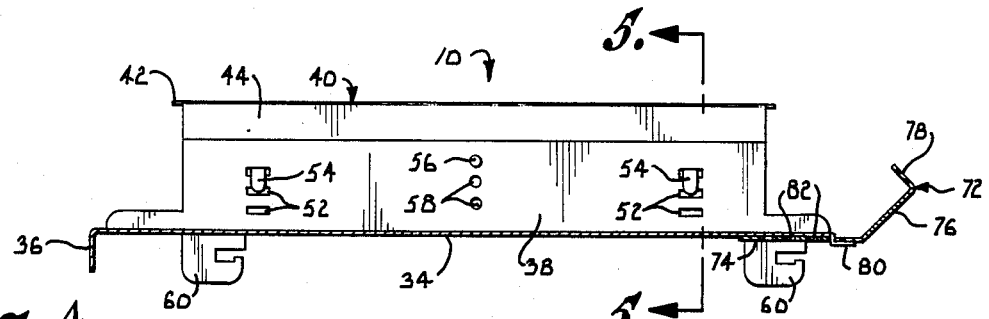
FIG. 4 is a sectional view taken generally along line 4—4 of FIG. 3 in the direction of the arrows.

The hanger brackets 40 can be connected to the sides 38 by inserting tabs 54 through the selected pair of slots 52 with the hanger bracket oriented properly to permit the tabs to fit through the slots. Flange 44 of each hanger bracket lies flatly against the outside surface of the corresponding side 38 and extends along the entire length of the side. When the tabs 54 are extended through the upper slots 52 as shown in FIGS. 1 and 2, the bracket plate 34 is located the maximum distance below the horizontal flanges 42 of the hanger brackets and is thus located the maximum distance below the cabinet bottom panel 26. Tabs 54 can be fitted through the lower slots in each side to thereby locate bracket plate 34 the minimum distance below the cabinet panel 26. When the tabs are fitted through the intermediate slots in each side 38, bracket plate 34 is at an intermediate location relative to panel 26 of the cabinet.

The hanger brackets 40 and bracket plate 34 are held in place relative to one another by a pair of screws 56. The vertical flange 44 of each hanger bracket 400 has an opening near its center through which the corresponding screw 56 is extended. Each side 38 has a vertical column of circular openings 58 through which the screw 56 can be threaded. After the tabs 54 have been inserted through the desired slots 52, each screw 56 is threaded through the opening 58 which is then aligned with the screw, and the bracket plate 34 is thereby rigidly secured to the hanger brackets 40. The screws 56 can be threaded out of openings 58 to permit the tabs 54 to be installed in a different set of slots 52 bfore the screws are again tightened.

Figure 8:
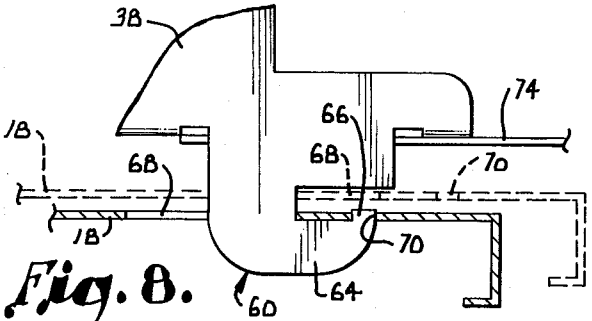
FIG. 8 is a fragmentary sectional view on an enlarged scale taken generally along line 8—8 of FIG. 7 in the direction of the arrows.

Each side 38 of the bracket plate 34 is provided with a pair of depending hooks 60 on which the toaster oven broiler 12 is suspended. As best shown in FIG. 8, each hook 60 has a relatively wide shank 62 which connects at its lower end with a body portion 64 of the hook. An upwardly extending tip 66 is located on the end of the body 64 remote from the shank 62. The hooks 60 are located on the front and back portions of each side 38.

As best shown in FIG. 2, the top panel 18 of the toaster oven broiler 12 is provided with four slots 68, each of which is spaced slightly away from a smaller rectangular opening 70. The slots 68 and openings 70 are located to receive the hooks 60. With additional reference to FIG. 8, each slot 68 is considerably longer than the corresponding dimension of the hook shank 62, while the openings 70 are substantially equal in size to the tips 66 of the hooks. The toaster oven broiler 12 can be applied to the hooks 60 by aligning slots 68 below the hook and raising the toaster oven broiler such that the hooks are extended through the slots. This is the position shown in broken lines in FIG. 8. The toaster oven broiler can then be shifted to the rear until the openings 70 are aligned above the tips 66 of the hooks. When the toaster oven broiler is then lowered, the tips 66 enter openings 70 and the shanks 62 remain extended through slots 68. The top panel 18 of the toaster oven broiler rests on top of the body portion 64 of each hook in the area between the shank 62 and tip 66.

The front edge of the bracket plate 34 is equipped with a deflector panel 72 which serves to deflect heat, moisture and grease vapors away from the front of the cabinet 14. The deflector panel 72 extends along the entirety of the front edge of plate 34 and includes a flat mounting flange 74 which lies flatly against the underside of the bracket plate 34 along its front edge. An inclined deflector plate 76 is bent to extend upwardly and forwardly from the front edge of the mounting flange 74 at an angle of approximately 45° from horizontal. The free edge of the deflector plate 76 is bent to provide a short lip 78 which is perpendicular to the deflector plate 76.

The deflector panel 72 is connected with the bracket plate 34 in an adjustable manner similar to the slot and tab arrangement described earlier in connection with the hanger brackets 40. The front edge of bracket plate 34 is provided near its opposite sides with a pair of tabs 80 which are bent downwardly a short distance and then project forwardly beyond the front edge of the bracket plate. The mounting flange 74 of deflector panel 72 is provided with two sets of slots 82 each set of which includes four slots spaced uniformly apart. The tabs 80 can be inserted through selected pairs of the slots 82 in order to locate the deflector plate 76 and lip 78 the desired distance forwardly of the front edge of the bracket plate 34. For example, by fitting tabs 80 through the first pair of slots 82 as shown in FIG. 1, the deflector plate 76 can be located the minimum distance away from the body of the bracket plate. Conversely, tabs 80 can be extended through the last set of slots 82 to locate the deflector plate the maximum distance from the body of the bracket plate. The two intermediate sets of slots permit the deflector plate to be located at intermediate positions.

A screw 84 serves to secure the deflector panel 72 in place on the bracket plate 34. The screw is extended through an opening in flange 74 and can be threaded through any one of a series of circular openings 86 which are formed through the bracket plate 34 near its front edge. When the tabs 80 have been inserted through the desired slots 82, screw 84 is threaded through the opening 86 which is then aligned with the screw. The screw can be removed to permit adjustment of the deflector panel 72, and the screw is again tightened once the desired adjustment has been made.

The undercabinet mounting assembly 10 is installed by first selecting the desired location for the toaster oven broiler 12. If the bottom panel 26 of the cabinet 14 is recessed a considerable distance above the lower edges of the side panels 20 and front panel 22, tabs 54 should be extended through the upper set of slots 52 so that the bracket plate 34 is located below the bottom edges of the cabinet panels 20 and 22. If the bottom panel 26 is flush with the lower edge of the cabinet or is only recessed a short distance upwardly, the lower set of slots 52 or intermediate set of slots should be selected. Once the tabs 54 have been extended through the proper slots 52, the screws 56 are tightened to secure the hanger brackets 40 rigidly to the bracket plate 34.

The deflector panel 72 should also be adjusted to the proper location. If the cabinet door 24 is relatively thick and extends to the bottom edge of the cabinet, tabs 80 should be inserted through the slots 82 which locate the inclined deflector plate 76 the maximum distance away from plate 34 in order to readily accommodate opening and closing of the cabinet door. If the lower edge of the cabinet door 24 is located well above the bottom of the front panel 22, as shown in FIG. 1, tabs 80 should be extended through the first pair of slots 82 to locate the inclined deflector plate 76 the minimum distance away from the bracket 34. The intermediate sets of slots 82 allow for intermediate adjustment of the deflector panel 72. Once the tabs 80 have been extended through the proper set of slots 82, screw 84 should be tightened to secure the deflector panel in place.

Once these adjustments have been made, the hanger brackets 40 should be applied to the underside of the bottom cabinet panel 26 with the forward ends of the hanger brackets positioned adjacent to the front panel 22 of the cabinet. While held in this position, the cabinet panel 26 should be marked through holes 46, and the holes 48 can be drilled through panel 26 at the locations indicated by the mark. After the bolts 50 have been applied from inside of the cabinet, the mounting assembly 10 is fully secured to the bottom panel 26 of the cabinet. It is preferred that the back panel of the toaster oven broiler be located at least two inches away from the back wall 30, and the toaster oven broiler should be no closer than about twelve inches away from a side wall and six inches away from a corner cabinet. The mounting assembly should not be installed above an oven or other cooking or heating appliance of over a sink, and it should be located close enough for the electrical cord of the toaster oven broiler to reach an electrical wall outlet.

Once the undercabinet mounting assembly 10 has been applied to the cabinet in this manner, the toaster oven broiler 12 can be installed on the hooks 60 in the manner indicated previously. It is noted that flange 36 slightly overlaps the upper edge portion of the back of the appliance. The toaster oven broiler can be removed from the mounting assembly for cleaning or use on a counter top simply by reversing the procedure involved in applying it to the hooks 60. Once installed to the bottom of the cabinet 14, the toaster oven broiler 12 can be operated in the usual manner. The bracket plate 34 is large enough to substantially cover the entire top of the toaster oven broiler and serves as a heat shield to prevent the heat that is generated by the appliance from heating the cabinet 14 and particularly its bottom panel 26 to an excessively high temperature. In this respect, it is noted that the bracket plate 34 is spaced well below panel 26 and above the top panel 18 of the toaster oven broiler.

The deflector panel 72 deflects heat and vapors away from the front panel 22 and doors 24 of the cabinet. When the front access door 16 of the toaster oven broiler is opened, considerable heat, grease vapors and moisture are released. Since the deflector panel 72 extends above and forwardly or outwardly beyond the front of the toaster oven broiler and the door 16, as best shown in FIG. 6, the heat, grease vapors and moisture that are released from the appliance are deflected by the inclined deflector plate 74 generally away from the front of the cabinet 14. The deflector panel thus protects the cabinet against discoloration and other damage that could be caused to its surface finish due to exposure to heat, grease and moisture.

In this manner, the undercabinet mounting assembly of the present invention permits a cooking appliance such as the toaster oven broiler 12 to be mounted to the bottom of a kitchen cabinet having virtually any size and style. The adjustable connection between the hanger brackets 40 and bracket plate 34 permit the mounting arrangement to accommodate various sizes and styles of cabinets, while the adjustable connection for the deflector panel 72 likewise accommodates various types and styles of cabinet fronts.

The four hooks 60 securely mount the toaster oven broiler on the bracket plate 34 and at the same time permit the appliance to be quickly and easily removed for cleaning, use on a counter top or other purposes. The mounting assembly 10 can be easily installed without the need for any special skills or special tools, and it can be applied to both new cabinets and to cabinets which are already installed.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. An undercabinet mounting arrangement for mounting a cooking appliance having a front access door under a kitchen cabinet having a bottom panel, said mounting arrangement comprising:

a rigid bracket plate having a front edge portion and a size to substantially cover the top of the appliance to shield the cabinet from the heat generated thereby;

means for securing said bracket plate to the bottom panel of the cabinet at a location beneath the bottom panel;

means for supporting the cooking appliance on said bracket plate in suspension therefrom with the bracket plate located between the appliance and the bottom panel to shield the cabinet from heat generated by the appliance; and a deflector projecting from said front edge portion of said bracket plate beyond and above the door of the appliance at a location to deflect heat and vapors away from the cabinet.

2. The invention of claim 1, wherein said deflector includes:

a deflector panel having a length to extend substantially the entire length of said front edge portion of the bracket plate; and detachable means for connecting said deflector panel to said front edge portion of the bracket plate.

3. The invention of claim 2, wherein said deflector panel includes:

a mounting flange for attachment to said front edge portion; and an inclined deflector plate extending upwardly and outwardly from said mounting flange when same is connected to said front edge portion of the bracket plate.

4. The invention of claim 3, including a lip on said inclined plate oriented generally perpendicular thereto and located on an edge of the inclined plate remote from said mounting flange.

5. The invention of claim 2, wherein said detachable means includes means for adjusting the extent to which said deflector panel projects beyond said front edge portion of the bracket plate.

6. The invention of claim 5, wherein said detachable means includes:

two sets of slots in said deflector panel each including a plurality of spaced apart slots;

a pair of tabs on said front edge portion of the bracket plate, said tabs fitting in said slots with one tab fitting in a selected slot in one set and the other tab fitting in the corresponding slot in the other set; and releasable means for fastening said deflector panel to said bracket plate with said tabs fitted in selected slots, thereby permitting the position of the deflector panel relative to the bracket plate to be adjusted.

7. The invention of claim 1, wherein said supporting means includes:

a plurality of slots in the cooking appliance; and a plurality of hooks on said bracket plate, said appliance being applicable to said bracket plate with said hooks being received in said slots in a manner to suspend the appliance on said hooks.

8. The invention of claim 1, wherein said securing means includes:

a pair of hanger brackets;

means for mounting said hanger brackets to the bottom panel of the cabinet at spaced apart locations;

a pair of opposite sides of said bracket plate; and detachable means for connecting said opposite sides of the bracket plate to said hanger brackets, thereby mounting said bracket plate beneath the bottom panel of the cabinet.

9. The invention of claim 8, wherein said detachable means includes means for adjusting the distance of said bracket plate below the bottom panel of the cabinet.

10. The invention of claim 9, wherein said detachable means includes:

two sets of slots in each of the sides of the bracket plate, each set including a plurality of spaced apart slots;

a pair of tabs on each hanger bracket having a size to fit in the slots; and releasable means for fastening said sides of the bracket plate to said hanger brackets with said tabs fitted in selected slots, whereby the sides can be fastened to the hanger brackets with said tabs fitted in different slots to adjust the elevation of said bracket plate relative to said hanger brackets.

11. An under cabinet mounting arrangement for mounting a cooking appliance having a front access door under a kitchen cabinet having a bottom panel, said mounting arrangement comprising:

a rigid bracket plate having a size to substantially cover the top of the appliance to shield the cabinet from the heat generated thereby;

means for securing said bracket plate to the bottom panel of the cabinet at a location beneath the bottom panel; and means for supporting the cooking appliance on said bracket plate in suspension therefrom with the bracket plate located between the appliance and the bottom panel to shield the cabinet from heat generated by the appliance;

said bracket further having a deflector portion located at a front edge thereof that extends beyond and above the door of the appliance at a location to deflect heat and vapors away from the cabinet.

* * * * *

UNITED STATES PATENT AND TRADEMARK OFFICE

CERTIFICATE OF CORRECTION

PATENT NO. : 4,580,853

DATED : April 8, 1986

INVENTOR(S) : Franklin C. Hitzeroth & Gilbert S. Aderton

It is certified that error appears in the above-identified patent and that said Letters Patent are hereby corrected as shown below:

In the claims, claim 11, line 16, --plate-- should be inserted between "bracket" and "further".

Signed and Sealed this

*Twelfth* Day of *August 1986*

[SEAL]

*Attest:*

DONALD J. QUIGG

*Attesting Officer*

*Commissioner of Patents and Trademarks*